US009662541B2

(12) United States Patent
Hwang et al.

(10) Patent No.: US 9,662,541 B2
(45) Date of Patent: May 30, 2017

(54) GOLF BALL HAVING DISCONTINUOUS ANNULAR DIMPLES

(71) Applicant: VOLVIK INC., Chungcheongbuk-do (KR)

(72) Inventors: In Hong Hwang, Gyeonggi-do (KR); Kyung Ahn Moon, Seoul (KR)

(73) Assignee: Volvik, Inc., Chungcheongbuk-Do (KR)

( * ) Notice: Subject to any disclaimer, the term of this patent is extended or adjusted under 35 U.S.C. 154(b) by 0 days.

(21) Appl. No.: 14/821,029

(22) Filed: Aug. 7, 2015

(65) Prior Publication Data

US 2016/0303428 A1 Oct. 20, 2016

(30) Foreign Application Priority Data

Apr. 14, 2015 (KR) ..... 10-2015-0052410

(51) Int. Cl.
*A63B 37/06* (2006.01)
*A63B 37/00* (2006.01)

(52) U.S. Cl.
CPC ..... *A63B 37/001* (2013.01); *A63B 37/002* (2013.01); *A63B 37/0019* (2013.01); *A63B 37/0006* (2013.01)

(58) Field of Classification Search
CPC ..... A63B 37/0015
USPC ..... 473/383, 384
See application file for complete search history.

(56) References Cited

U.S. PATENT DOCUMENTS

| | | | | |
|---|---|---|---|---|
| 4,681,323 | A * | 7/1987 | Alaki | A63B 37/0004 273/DIG. 22 |
| 5,547,197 | A | 8/1996 | Pocklington | |
| 5,879,245 | A | 3/1999 | Hwang | |
| 5,957,787 | A | 9/1999 | Hwang | |
| 6,709,349 | B2 | 3/2004 | Sullivan | |
| 7,273,426 | B2 * | 9/2007 | Sato | A63B 37/0004 473/383 |
| 2012/0302377 | A1 | 11/2012 | Sato et al. | |
| 2014/0004977 | A1 * | 1/2014 | Hwang | A63B 37/0004 473/384 |

FOREIGN PATENT DOCUMENTS

| | | | |
|---|---|---|---|
| JP | H08-276035 | A | 10/1996 |
| KR | 10-1197666 | B1 | 10/2012 |

* cited by examiner

*Primary Examiner* — Raeann Gorden
(74) *Attorney, Agent, or Firm* — Kilpatrick Townsend & Stockton LLP

(57) ABSTRACT

A golf ball in which a surface of a sphere is divided into a plurality of spherical polyhedrons and dimples are formed in each divided surface. A discontinuous annular dimple is formed over two or more of the dimples. The discontinuous annular dimple is substantially formed in a ring shape and a concave indented from a surface of the golf ball and a land portion formed as the same plane as the surface of the golf ball are alternately arranged in a direction along a circumference of a ring.

11 Claims, 2 Drawing Sheets

GOLF BALL HAVING DISCONTINUOUS ANNULAR DIMPLES

CROSS-REFERENCE TO RELATED APPLICATION

This application claims the benefit of Korean Patent Application No. 10-2015-0052410, filed on Apr. 14, 2015, in the Korean Intellectual Property Office, the disclosure of which is incorporated herein in its entirety by reference.

BACKGROUND

1. Field

One or more exemplary embodiments relate to a golf ball, and more particularly, to a golf ball which has a superior straight flight feature and an increased flight time upon being hit by controlling the shapes of the dimples formed in a surface of the golf ball so that a flight distance and flight stability may be greatly improved.

2. Description of the Related Art

Dimples in a surface of a golf ball directly affect aerodynamic flight of the golf ball.

When the golf ball is hit using a golf club, the golf ball starts to fly due to a strong repulsive elasticity generated from the core of the golf ball and simultaneously a backspin of the golf ball is generated according to a loft angle of the golf club. A trajectory of the golf ball in flight has a different form according to various specifications of the golf ball.

Even when initial trajectories are similar to one another, the shape of a trajectory, the apex of a trajectory, flight time, etc. may greatly vary according to the type, shape or arrangement of the dimples. Also, even when the same golfer hits the golf ball by using the same golf club, the flight characteristics of the golf ball vary according to the differences in repulsive elasticity, rigidness, and spin performance of the golf ball. Particularly, duration of flight, the height of an apex, straightness of flight, effects of wind, etc. greatly vary according to the shape, size, number, size ratio, depth, arrangement method, etc. of the dimples.

In general, the most used dimple shape of a golf ball is a circular dimple. The circular dimple is most widely used because it easily maintains a constant air flow and enables a balanced arrangement over an overall surface of the golf ball. Also, since manufacturing of a mold cavity is easy, the circular dimple is applied to many golf balls. In regard to the circular dimple, however, flight performance of a golf ball greatly varies according to the size of the dimple. For a relatively small circular dimple, it may be difficult to get lift but a wind effect may be lower and thus more stable flight may be possible. In contrast, for a relatively large circular dimple, it may be easy to get lift but the wind effect may be higher and thus flight may be less stable. Accordingly, the golf ball may fly in an unintended direction toward an unintended destination. Also, when putting a golf ball, in the case of a large dimple, since there is a difference between when a surface of a putter contacts a land surface where no dimple is formed and when the surface of a putter directly contacts a surface of a dimple, directional consistency may not be guaranteed. In particular, the difference may increase further when short distance putting is performed. To overcome the above problem, every effort has been made by many people.

U.S. Pat. No. 5,879,245 discloses that neighboring dimples in a surface of a sphere divided into a spherical polyhedron are connected via air connection channels so that independence of each dimple is reduced, providing continuity in a flow of air, and thus the drag generated during flight of a golf ball is reduced and the flight stability and the flight distance are increased. However, since the surface of a golf ball having much unevenness due to the connection channels may be easily damaged during hitting by a short iron or wedge, the durability of the golf ball may be reduced.

U.S. Pat. No. 5,957,787 discloses that a surface of a sphere is divided into 20 spherical surfaces, the largest circular dimples are arranged at a center area of each spherical triangle, and an annular dimple having the same center as the circular dimple is arranged outside the circular dimple so that a drag coefficient in a low-speed area may be lowered and rotation may be maintained relatively longer when the annular dimple is disposed in a direction perpendicular to an air flow direction, thereby providing the flight stability and increasing the flight distance. However, due to an annular concave surface having one large continuous depth, a flow of air in the annular dimple becomes strong so that an initial trajectory may be excessively lowered and thus an increase in the flight distance with an appropriate trajectory may be difficult to achieve.

U.S. Pat. No. 6,709,349 discloses that, in arrangement of the dimples in a surface of a golf ball, radial arms in various shapes including a concave surface or a protruding portion are radially formed from a center of a dimple or a position almost close to the center, or radial arms in a uniform shape from a hub to an edge at the center of a dimple, and sub-dimples in various shapes are formed in an edge portion of a dimple or inside the dimple, thereby increasing the flight distance by agitating the flow of air to quickly convert the flow energy of air into flying energy of a golf ball. However, in '349 patent, since the sub-dimples are formed symmetrically in each dimple area relative to a center of each dimple, and the entire portion of the inside of one dimple receives the same pressure at any position thereof, not helping a rotational force, but increasing pressure drag and frictional drag of a golf ball, thereby decreasing the flight distance due to a rapid change in a trajectory during flight.

U.S. Patent Publication No. 2012/0302377 A1 discloses that elliptical or non-circular dimples are arranged in a surface of a golf ball having a spherical polyhedron shape, and the dimples have a non-circular shape which has a major axis of a length at least 1.2 times greater than that of a minor axis thereof, are each composed of a pair of circular arcs, and have a depth which causes the peripheral edges of the dimples to generate turbulence so that a separation width at a separation boundary may be reduced to a level less than that of a golf ball having circular dimples and thus the drag during flight of a golf ball may be decreased while increasing the flight distance. However, since there is a large difference between the major axis and the minor axis in the dimples having the above shape, if the same portion of a golf ball is not repeatedly hit during hitting, flight directions differ when a major axis side is hit or a minor axis side is hit so that flight stability may be seriously reduced.

In a general circular dimple, when the size of a dimple is equal to or greater than 0.19 inch, it is easy to get lift but wind effect may be increased during flight so that flight stability becomes poor. In contrast, when the size of a dimple is equal to or less than 0.14 inch, it is easy to achieve flight stability but it may be difficult to get lift so that the flight distance may be relatively short. Also, when putting, a difference is generated between when a relatively large dimple contacts a putter surface and when a relatively small dimple contacts the putter surface, in the case of the relatively large dimple, the golf ball may roll in a direction that is different from an intended direction within a short distance.

SUMMARY

One or more exemplary embodiments include a golf ball having improved flight characteristics by generating fast and stable spin to increase a flight time of the golf ball and removing an excessive wind effect on an entire surface of the golf ball to make the pressure drag uniform and providing the flight stability.

Additional aspects will be set forth in part in the description which follows and, in part, will be apparent from the description, or may be learned by practice of the presented exemplary embodiments.

According to one or more exemplary embodiments, providing a golf ball in which a surface of a sphere is divided into a spherical polyhedron and dimples are formed in each divided surface. In the golf ball, a discontinuous annular dimple is formed over two or more of the dimples, and the discontinuous annular dimple is substantially formed in a ring shape and a concave indented from a surface of the golf ball and a land portion formed as the same plane as the surface of the golf ball are alternately arranged in a direction along a circumference of a ring.

A left-right width W1 of the concave with respect to a circumferential direction of the discontinuous annular dimple may about 0.5 mm to about 2.5 mm.

The dimples may be circular dimples and diameters of the circular dimples may be identical to each other.

The dimples may be circular dimples and a diameter of each of the circular dimples may be about 0.8 mm to about 6 mm.

A depth of the discontinuous annular dimple may be a frustum depth and is about 0.0065 inches to about 0.008 inches.

The dimples may be circular dimples and a depth of each of the circular dimples may be about 0.1 mm to about 0.2 mm.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
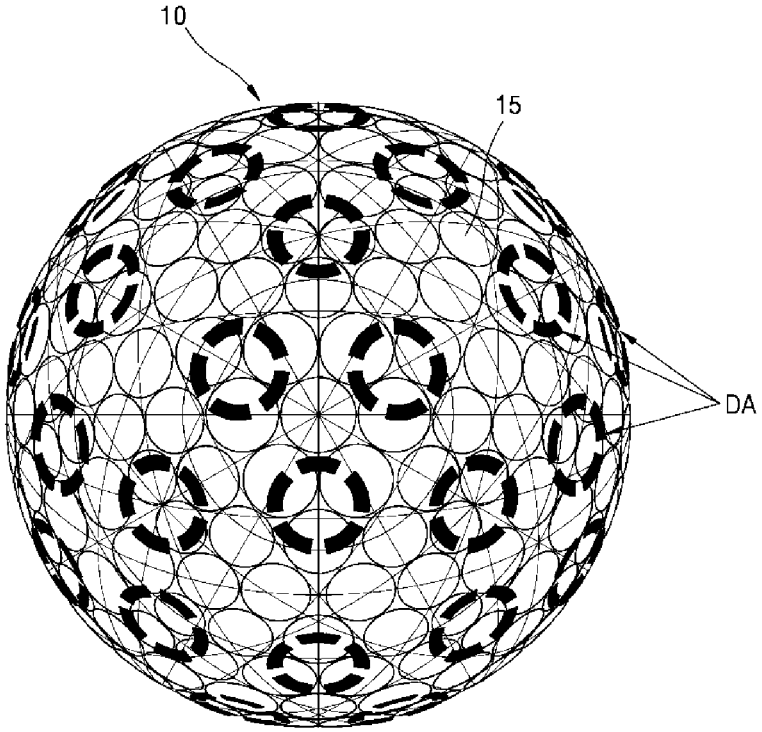
FIG. 1 illustrates a golf ball according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

In general, dimples are formed in a surface of a golf ball because the role of dimples is important in terms of aerodynamics. A golf ball flies to a target position in a back spin state, the dimples make the air flow slowly under the golf ball which increasing pressure and the air flow fast above the golf ball, decreasing pressure, thereby generating the lift by the Bernoulli's principle that enables longer flight. In this state, pressure drag and friction drag increase as well. It is well known that the circular dimples have been most widely used as the dimples of a golf ball. When arranging the circular dimples in a surface of a sphere, a golf ball is formed in the shape of a spherical polyhedron obtained by dividing the surface of a sphere by great circles and the circular dimples are arranged in a left-right symmetry on the spherical polyhedron. In addition to the circular dimple, dimples of various shapes such as an ellipse, a spherical hexagon, a spherical triangle, etc. have been used. However, the circular dimples have been used for most golf balls because a flow of air is symmetrically uniform so that straight flight may be easily achieved and an abrupt change of a flight trajectory due to wind effect may less occur.

For a relatively large circular dimple, it may be easy to get a lift but wind effect during flight may be relatively higher so that the flight may be unstable. In contrast, for a relatively small circular dimple, it may be difficult to get a lift but the wind effect during flight may be lower so that the flight may be stable but a flight distance may be relatively decreased. Also, when putting, a contact surface varies between when a large dimple contacts a surface of a putter and when a small dimple contacts the surface of the putter, in case of the large dimple, the golf ball may often go in a direction different from an intended direction at a short distance.

To address the above shortcomings of the circular dimple, a discontinuous annular dimple of the present invention has been developed. For a golf ball with circular dimples, it may be easy to get lift when an area ratio of a portion where dimples are formed is over 76% of an overall surface area. When the discontinuous annular dimple according to the present invention is employed, it is easy to secure a dimple area ratio of over 76%.

A golf ball having discontinuous annular dimples according to the present invention has a basic purpose of increasing the ratio of an area occupied by the dimples and uniformly maintain an air circulation phenomenon formed at the back side during flight of the golf ball. The discontinuous annular dimple in combination with two or more circular dimples functions as one big dimple helping to significantly increases lift during the initial flight of the golf ball. The discontinuous annular dimple is quite different from a continuous annular dimple. The continuous annular dimple has an annular concave surface having a large continuous depth which increases flow of air in the annular dimple so that an initial trajectory may be excessively lowered and thus improvement of the flight distance by an appropriate trajectory may be difficult. In contrast, the discontinuous annular dimple is discontinuously formed so as to prevent a trajectory from being excessively lowered.

FIG. 1 illustrates a golf ball 10 having the discontinuous annular dimples according to an exemplary embodiment.

As illustrated in FIG. 1, the golf ball 10 having discontinuous annular dimples of the present exemplary embodiment includes circular dimples 15 and discontinuous annular dimples (DAs) in divided surfaces on a spherical polyhedron, for example, a spherical polyhedron of 6-8 surfaces, that is, a spherical polyhedron corresponding to a three-dimensional figure obtained by truncating 8 pyramid corner portions from a regular hexahedron.

In the golf ball 10 according to the present exemplary embodiment, adjacent three or five circular dimples 15 are connected by the discontinuous annular dimples.

When the discontinuous annular dimples are formed, the drag, a resistance force acting the rear side of a flight direction, which occurs as an air circulation phenomenon generated when the golf ball flies with a backspin abruptly the air circulation disheveled, and, the drag may be reduced. The depth of the discontinuous annular dimple is a frustum depth in which edges of a dimple are linearly connected to each other, which may be 0.0065 inches to 0.008 inches.

Although only a case of employing circular dimples is illustrated in the drawings, the dimple connected by the discontinuous annular dimple may be a dimple having a regular shape, for example, a circular dimple, a triangular dimple, or a rectangular dimple. However, circular dimples are most widely used and, in this case, the diameters of circular dimples may be identical to or different from each other. The diameter of each circular dimple may be about 0.8 mm to about 6 mm, and the depth of each circular dimple may be about 0.1 mm to about 0.2 mm.

Figure 2:
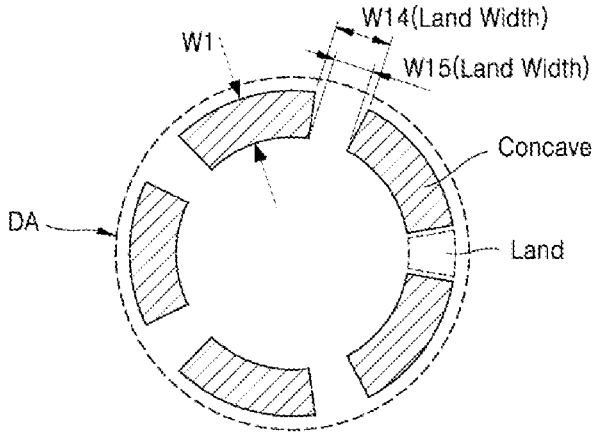
FIG. 2 is an enlarged plan view of a discontinuous annular dimple illustrated in FIG. 1.

FIG. 2 is an enlarged plan view of a discontinuous annular dimple illustrated in FIG. 1.

As illustrated in FIG. 2, the discontinuous annular dimple includes land portions where no concave is formed along a circumferential direction of a ring shape. Namely, a concave indented from a surface of the golf ball and a land portion formed as the same plane as the surface of the golf ball are alternately arranged in a direction along a circumference of a ring. A left-right width W1 of the concave with respect to a circumferential direction of the discontinuous annular dimple may be 0.5 mm to 2.5 mm.

The land portion discontinuously existing in the ring shape has an outer width W14 and an inner width W15. The outer width W14 may be greater than the inner width W15 by about 0.005 inches to about 0.05 inches, which facilitates longer duration of air circulation.

The golf ball with the circular dimples to which are added the discontinuous annular dimples has a dimple area ratio of over 76%, thereby easily obtaining lift. Also, the drag that occurs as an air circulation phenomenon generated when the golf ball flies with a backspin abruptly the air circulation disheveled, and, the drag may be reduced. Additionally, the shortcoming of the continuous annular dimple, that is, a flow of air in the dimple is too strong so that an initial trajectory may be excessively lowered after the golf ball is hit, may be overcome.

Figure 3:
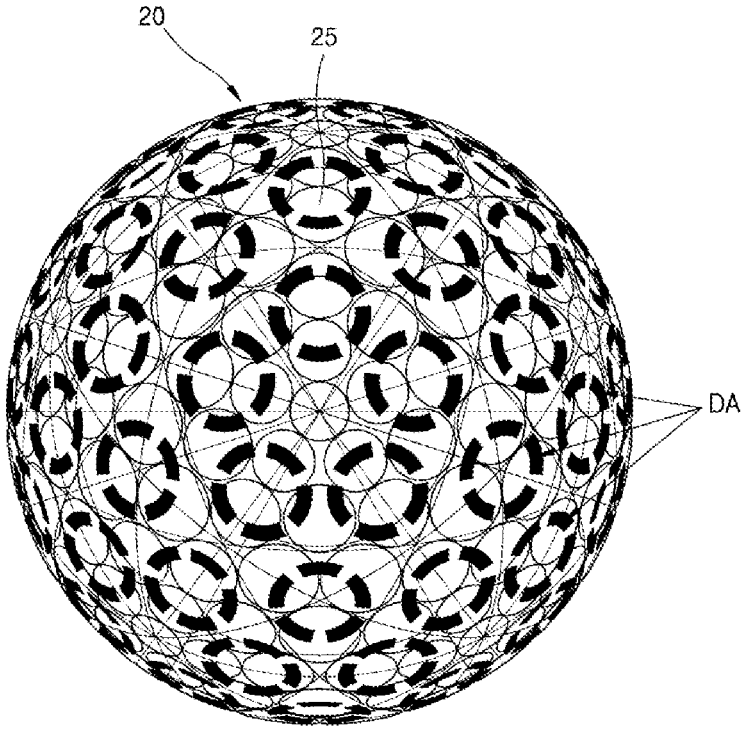
FIG. 3 illustrates a golf ball according to another exemplary embodiment.

FIG. 3 illustrates a golf ball 20 according to another exemplary embodiment.

As illustrated in FIG. 3, circular dimples 25 and discontinuous annular dimples DAs are arranged on the golf ball 20 that is a spherical polyhedron, for example, spherical polyhedrons of 20-12 surfaces, that is, a spherical polyhedron corresponding to a three-dimensional figure formed of 12 regular pentagons and 20 regular triangles. The discontinuous annular dimple may be formed over a combination of three circular dimples or four comma dimples. As such, when the discontinuous annular dimple is used, compared with a case in which only the circular dimples exist, even when a dimple area ratio decreases by employing relatively small circular dimples, the discontinuous annular dimple may compensate for the decreased part of an entire dimple area ratio. Also, the lowering of the initial trajectory of a golf ball after being hit may be improved compared to the continuous annular dimple and the drag occurring at the back of the golf ball flying with a backspin may be remarkably reduced.

Although the above descriptions discussed two exemplary embodiments, the present invention is not limited to the above-described spherical polyhedrons of 20-12 surfaces and 6-8 surfaces or to a case in which the discontinuous annular dimples are added to the golf ball where the circular dimples are formed. In other words, the present invention may be applied not only to a spherical polyhedron having an especially widely known geometric shape but also to any existing spherical polyhedron. Also, the dimples connected by the discontinuous annular dimple may be any existing dimples having not only a circular shape but also various polygonal shapes.

The discontinuous annular dimple applied to the golf ball of the present invention may prevent the excessive lowering of an initial trajectory due to an excessive air rotation flow in a conventional continuous annular dimple where a totally continuous concave surface is formed.

Also, the discontinuous annular dimple applied to the golf ball of the present invention may be combined with two or more circular dimples in a group to facilitate air circulation around the golf ball as it flies with a backspin.

Also, a golf ball having a ratio of a total area where the dimples are formed thereby easily obtaining lift of over 76% may be easily designed Also, the drag that occurs as an air circulation phenomenon generated when the golf ball flies with a backspin abruptly the air circulation disheveled, and, the drag may be reduced.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. A golf ball comprising a sphere, in which a surface of the sphere is divided into a spherical polyhedron and dimples are formed in each divided surface, wherein a discontinuous annular dimple is formed over two or more of the dimples in each divided surface, and the discontinuous annular dimple is substantially formed in a ring shape and a concave indented from the surface of the golf ball and a land portion formed as the same plane as the surface of the golf ball are alternately arranged in a direction along a circumference of a ring.

2. The golf ball of claim 1, wherein a left-right width W1 of the concave with respect to a circumferential direction of the discontinuous annular dimple is about 0.5 mm to about 2.5 mm.

3. The golf ball of claim 1, wherein the dimples are circular dimples and diameters of the circular dimples are identical to each other.

4. The golf ball of claim 1, wherein the dimples are circular dimples and a diameter of each of the circular dimples is about 0.8 mm to about 6 mm.

5. The golf ball of claim 1, wherein a depth of the discontinuous annular dimple is a frustum depth and is about 0.0065 inches to about 0.008 inches.

6. The golf ball of claim 1, wherein the dimples are circular dimples and a depth of each of the circular dimples is about 0.1 mm to about 0.2 mm.

7. A golf ball comprising a sphere, in which a surface of the sphere is divided into a spherical polyhedron and dimples are formed in each divided surface, wherein a discontinuous annular dimple is formed over two or more of the dimples, and the discontinuous annular dimple is substantially formed in a ring shape and a concave indented from the surface of the golf ball and a land portion formed as the same plane as the surface of the golf ball are alternately arranged in a direction along a circumference of a ring, wherein a left-right width W1 of the concave with respect to a circumferential direction of the discontinuous annular dimple is about 0.5 mm to about 2.5 mm.

8. The golf ball of claim 7, wherein the dimples are circular dimples and diameters of the circular dimples are identical to each other.

9. The golf ball of claim 7, wherein the dimples are circular dimples and a diameter of each of the circular dimples is about 0.8 mm to about 6 mm.

10. The golf ball of claim 7, wherein a depth of the discontinuous annular dimple is a frustum depth and is about 0.0065 inches to about 0.008 inches.

11. The golf ball of claim 7, wherein the dimples are circular dimples and a depth of each of the circular dimples is about 0.1 mm to about 0.2 mm.

* * * * *